US006652667B2

(12) United States Patent
Ahmadi et al.

(10) Patent No.: US 6,652,667 B2
(45) **Date of Patent: *Nov. 25, 2003**

(54) METHOD FOR REMOVING ENGINE DEPOSITS IN A GASOLINE INTERNAL COMBUSTION ENGINE

(75) Inventors: Majid R. Ahmadi, Pleasant Hill, CA (US); Damon C. Vaudrin, Vacaville, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 75 days.

This patent is subject to a terminal disclaimer.

(21) Appl. No.: 10/056,123

(22) Filed: Jan. 23, 2002

(65) Prior Publication Data

US 2003/0158060 A1 Aug. 21, 2003

(51) Int. Cl.[7] ..... B08B 3/04; C11D 7/26; C11D 7/32; C11D 7/50

(52) U.S. Cl. ..... 134/36; 134/39; 134/40; 134/42; 510/187; 510/421; 510/433; 510/499; 510/505; 510/506

(58) Field of Search ..... 510/187, 421, 510/433, 499, 505, 506; 134/36, 39, 40, 42

(56) References Cited

U.S. PATENT DOCUMENTS

| | | | | | |
|---|---|---|---|---|---|
| 4,407,741 | A | * | 10/1983 | Maggi | 252/542 |
| 4,671,230 | A | | 6/1987 | Turnipseed | |
| 4,680,133 | A | * | 7/1987 | Ward | 252/153 |
| 4,784,170 | A | | 11/1988 | Romanelli et al. | |
| 4,800,848 | A | | 1/1989 | Hubbard | |
| 4,807,578 | A | | 2/1989 | Adams et al. | |
| 4,881,945 | A | | 11/1989 | Buckley, III | |
| 4,927,551 | A | * | 5/1990 | Erdman et al. | 252/42.7 |
| 4,989,561 | A | | 2/1991 | Hein et al. | |
| 4,992,187 | A | | 2/1991 | Adams et al. | |
| 5,097,806 | A | | 3/1992 | Vataru et al. | |
| 5,257,604 | A | | 11/1993 | Vataru et al. | |
| 5,334,321 | A | * | 8/1994 | Harrison et al. | 252/51.5 |
| 5,334,331 | A | * | 8/1994 | Fusiak | 252/542 |
| 5,503,683 | A | | 4/1996 | Butcher et al. | |
| 5,665,690 | A | * | 9/1997 | Lucas et al. | 510/407 |
| 5,669,939 | A | | 9/1997 | Cherpeck | |
| 5,749,929 | A | | 5/1998 | Cherpeck et al. | |
| 5,853,434 | A | * | 12/1998 | Harrison et al. | 44/331 |
| 5,858,942 | A | | 1/1999 | Adams et al. | |
| 6,073,638 | A | | 6/2000 | Sasaki et al. | |
| 6,162,769 | A | * | 12/2000 | Polhaar et al. | 508/339 |

(List continued on next page.)

FOREIGN PATENT DOCUMENTS

| | | |
|---|---|---|
| WO | WO 90/10051 | 9/1990 |
| WO | WO 92/07176 | 4/1992 |
| WO | WO 00/20537 | 4/2000 |
| WO | WO 00/33981 | 6/2000 |

OTHER PUBLICATIONS

S. Matsushita, "Development of Direct Injection S.I. Engine (D–4)", Proceedings of JSAE (Japanese Society of Automotive Engineers), No. 9733440, pp 33–38, Mar. 1997.

*Primary Examiner*—Gregory Delcotto
(74) *Attorney, Agent, or Firm*—Joseph P. Foley; Claude J. Caroli

(57) ABSTRACT

Disclosed are methods for removing engine deposits in a gasoline internal combustion engine by introducing a cleaning composition into an air-intake manifold of a warmed-up and idling gasoline internal combustion engine and running the engine while the cleaning composition is being introduced. One such cleaning composition suitable for these methods comprises (a) a phenoxy mono- or poly (oxyalkylene) alcohol; (b) at least one solvent selected from (1) an alkoxy mono- or poly(oxyalkylene) alcohol and (2) an aliphatic or aromatic organic solvent; and (c) at least one nitrogen-containing detergent additive.

30 Claims, 2 Drawing Sheets

U.S. PATENT DOCUMENTS 6,192,901 B1 2/2001 Rome et al.
6,203,584 B1 3/2001 Fuentes-Afflick et al.
6,217,624 B1 4/2001 Morris et al.
6,239,090 B1 * 5/2001 Marquis et al. ..... 510/201
6,479,445 B1 * 11/2002 Machac, Jr. et al. ..... 510/206

* cited by examiner

METHOD FOR REMOVING ENGINE DEPOSITS IN A GASOLINE INTERNAL COMBUSTION ENGINE

BACKGROUND OF THE INVENTION

1. Field of the Invention

This invention relates to a method for removing engine deposits in a gasoline internal combustion engine. More particularly, this invention relates to a method for removing engine deposits in a gasoline internal combustion engine which comprises introducing a cleaning composition into an air-intake manifold of the engine and running the engine while the cleaning composition is being introduced.

2. Description of the Related Art

It is well known that automobile engines tend to form deposits on the surface of engine components, such as carburetor ports, throttle bodies, fuel injectors, intake ports and intake valves, due to the oxidation and polymerization of hydrocarbon fuel. These deposits, even when present in relatively minor amounts, often cause noticeable driveability problems, such as stalling and poor acceleration. Moreover, engine deposits can significantly increase an automobile's fuel consumption and production of exhaust pollutants.

Recently, direct injection spark ignition (DISI) engines have been introduced as an alternative to conventional port fuel injection spark ignition (PFI SI) engines. In the past few years, at least three types of DISI engines (from Mitsubishi, Toyota, and Nissan) have been commercially introduced into the Japanese market, and some models are now available in Europe and selected markets in Asia. Interest in these engines stems from benefits in the area of fuel efficiency and exhaust emissions. The direct injection strategy for spark ignition engines has allowed manufacturers to significantly decrease engine fuel consumption, while at the same time maintaining engine performance characteristics and levels of gaseous emissions. The fuel/air mixture in such engines is often lean and stratified (as opposed to stoichiometric and homogeneous in convention PFI SI engines), thus resulting in improved fuel economy.

Although there are many differences between the two engine technologies, the fundamental difference remains fuel induction strategy. In a traditional PFI SI engine, fuel is injected inside the intake ports, coming in direct contact with the intake valves, while in DISI engines fuel is directly introduced inside the combustion chamber. Recent studies have shown that DISI engines are prone to deposit build-up and in some cases, these deposits are hard to remove using conventional deposit control fuel additives. Given that the DISI engine technology is relatively new, there is concern that with accumulated use, performance and fuel economy benefits may diminish as deposits form on various surfaces of these engines. Therefore, the development of effective fuel detergents or "deposit control" additives to prevent or reduce such deposits in DISI engines is of considerable importance.

Generally, detergents and other additive packages have been added to the fuel in gasoline engines to prevent formation of and to remove deposits which are formed by the heavy components of the fuel. Typically, for these detergent additives in the fuel to remove deposits from the various parts of an engine, they needed to come into contact with the parts that require cleaning. As a consequence, problems in fuel delivery systems, including injector deposit problems, have been significantly reduced. However, even these components require occasional cleaning. Specific engine configurations have more pronounced problematic deposit areas due to the intake systems. For example, throttle body style fuel injector systems where the fuel is sprayed at the initial point of air flow into the system allows the intake to remain reasonably clean using the fuel additive, however PFI SI engines spray the fuel directly into the air stream just before the intake valves and DISI engines spray the fuel directly into the combustion chamber. As a result, upstream components from the fuel entry on the intake manifold of PFI SI and DISI engines are subject to increased formation of unwanted deposits from oil from the positive crankcase ventilation (PCV) system and exhaust gas recirculation (EGR). These upstream engine air flow components can remain with engine deposits even though a detergent is used in the fuel. Even with the use of detergents, some engine components when present, such as intake valves, fuel injector nozzles, idle air bypass valves, throttle plates, EGR valves, PCV systems, combustion chambers, oxygen sensors, etc., require additional cleaning.

Several generic approaches were developed to clean these problematic areas often focusing on the fuel systems. One common method is applying a cleaning solution directly to the carburetor into an open air throttle or the intake manifold of a fuel injection system, where the cleaner is admixed with combustion air and fuel, and the combination mixture is burned during the combustion process. These carburetor-cleaning aerosol spray cleaning products are applied to soiled areas into a running engine. The relatively slow delivery rate as well as the structure of the carburetor/manifold systems generally prevent the accumulation of cleaning liquid in the intake of the engine. However as is apparent for the intake manifold, the majority of the cleaner will take the path of least resistance to the closest combustion chamber of the engine often leading to poor distribution and minimal cleaning of some cylinders.

This technique has also been modified, to introduce a cleaning solution to the intake manifold through a vacuum fitting. Generally, these cleaning solutions are provided in non-aerosol form, introduced into a running engine in liquid form using engine vacuum to draw the product into the engine, as described in U.S. Pat. No. 5,858,942 issued Jan. 12, 1999. While these newer products may be generally more effective at cleaning the engine than the conventional aerosol cleaners, they suffer from a distribution problem in getting the cleaner to the multiple intake runners, intake ports, intake valves, combustion chambers, etc. Generally, the cleaning product was introduced into the intake manifold via a single point by disconnecting an existing vacuum line on the manifold and connecting a flex line from that vacuum point to a container containing the cleaning liquid and using engine vacuum to deliver the cleaning solution to that single port. While a metering device could be used limit the rate at which the cleaning solution was added to the intake manifold, the locations for addition of cleaning solution were fixed by the engine design of vacuum fittings on the intake manifold. Often such arrangements favored introduction of cleaning solution to some of the cylinders while others received less or none of the cleaning solution. More problematic is that some engine designs have an intake manifold floor, plenum floor or resonance chamber, which has a portion lower than the combustion chamber of the engine. This type of design will allow for cleaning solution to pool in these areas. This aspect, as well as introducing the cleaning solution at too great a rate, can accumulate and pool the cleaning solution in the manifold even though the engine is running. Generally, the vacuum generated within the manifold is not sufficient to immediately move this pooled liquid or atomize the liquid for introduction into the combustion chamber. However, upon subsequent operation of the engine or at higher engine speed, a slug of this liquid can be introduced into the combustion chamber. If sufficient liquid is introduced into the combustion chamber, hydraulic locking and/or catastrophic engine failure can result. Hydraulic locking and engine damage can result when a piston of the running engine approaches its fully extended position towards the engine head and is blocked by essentially an incompressible liquid. Engine operation ceases and engine internal damage often results.

Accordingly, disclosed herein is a method for removing engine deposits in a gasoline internal combustion engine and an illustrative apparatus for introducing a cleaner composition into an operating gasoline internal combustion engine, while providing discrete variable locations within an intake vacuum system for introduction of the cleaning solution. Such discrete locations can be independent of the engine vacuum port configuration and can be used to reduce or eliminate the possibility of pooling the cleaner solution into the intake manifold while allowing for improved distribution of the cleaner solution to affected areas.

SUMMARY OF THE INVENTION

The present invention provides a method for removing engine deposits in a gasoline internal combustion engine which comprises introducing a cleaning composition into an air-intake manifold of a warmed-up and idling gasoline internal combustion engine and running the engine while the cleaning composition is being introduced, said cleaning composition comprising:

(a) a phenoxy mono- or poly(oxyalkylene) alcohol having the formula:

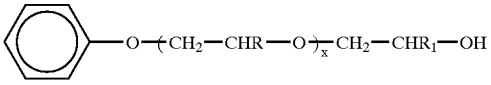

(I)

wherein R and $R_1$ are independently hydrogen or methyl and each R is independently selected in each —$CH_2$—CHR—O— unit; and x is an integer from 0 to 4; and mixtures thereof;

(b) at least one solvent selected from:

(1) an alkoxy mono- or poly(oxyalkylene) alcohol having the formula:

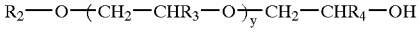

(II)

wherein $R_2$ is alkyl of 1 to about 10 carbon atoms; $R_3$ and $R_4$ are independently hydrogen or methyl and each $R_3$ is independently selected in each —$CH_2$—$CHR_3$—O— unit; and y is an integer from 0 to 4; and mixtures thereof; and (2) an aliphatic or aromatic organic solvent; and (c) at least one nitrogen-containing detergent additive.

In a preferred embodiment, the method of the present invention further comprises the subsequent step of introducing a second cleaning composition into the air-intake manifold of the warmed-up and idling engine and running the engine while the second cleaning composition is introduced, said second cleaning composition comprising a homogeneous mixture of:

(a) a phenoxy mono- or poly(oxyalkylene) alcohol having the formula:

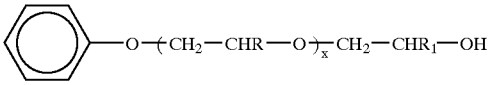

(I)

wherein R and $R_1$ are independently hydrogen or methyl and each R is independently selected in each —$CH_2$—CHR—O— unit; and x is an integer from 0 to 4; or mixtures thereof;

(b) an alkoxy mono- or poly(oxyalkylene) alcohol having the formula:

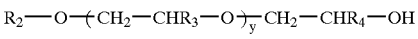

(II)

wherein $R_2$ is alkyl of 1 to about 10 carbon atoms; $R_3$ and $R_4$ are independently hydrogen or methyl and each $R_3$ is independently selected in each —$CH_2$—$CHR_3$—O— unit; and y is an integer from 0 to 4; or mixtures thereof; and (c) water.

In an alternative embodiment, the present invention is further directed to a method for delivering a cleaning composition to the intake system of a gasoline internal combustion engine which comprises introducing a cleaning composition into an air-intake manifold of a warmed-up and idling gasoline internal combustion engine through a transport means inserted into and located within the interior of the engine to thereby deliver the cleaning composition to each combustion chamber, and running the engine while the cleaning composition is being introduced. This transport means is separate from the fuel delivery system of the engine.

Among other factors, the present invention is based on the discovery that intake system deposits, particularly intake valve and combustion chamber deposits, can be effectively removed in gasoline internal combustion engines by employing the unique method described herein. Moreover, the method of the present invention is suitable for use in removing deposits in conventional engines including conventional port fuel injection spark ignition (PFI SI) engines and in direct injection spark ignition (DISI) gasoline engines. The present method is especially suitable for use in DISI gasoline engines.

DETAILED DESCRIPTION OF THE INVENTION

Figure 1:
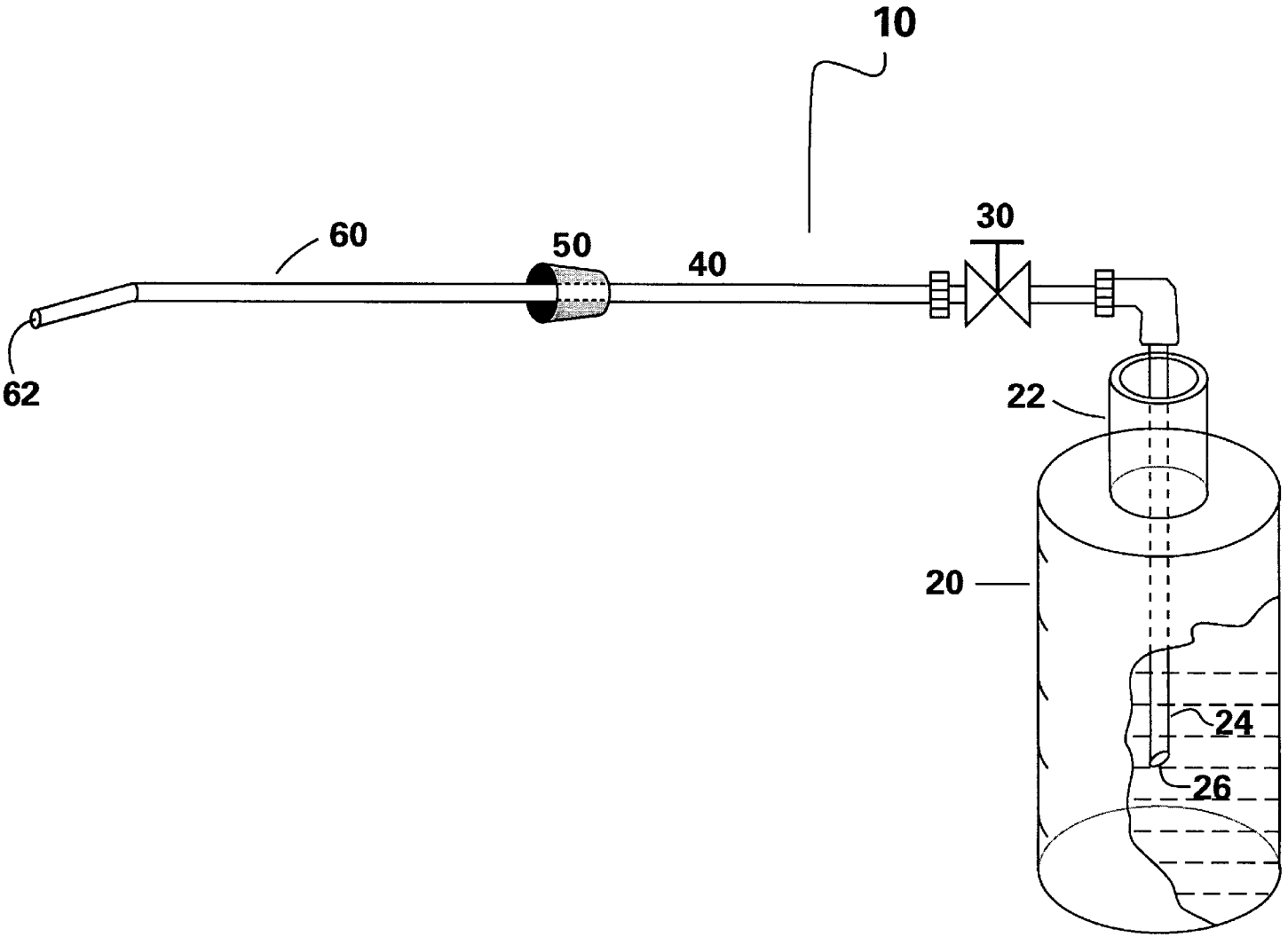
FIG. 1 is one embodiment of an apparatus for carrying out the method of the present invention.

In one embodiment, the method of the present invention comprises introducing a cleaning composition into an air-intake manifold of a previously warmed-up and idling gasoline internal combustion engine and running the engine while the cleaning composition is being introduced, wherein the cleaning composition comprises (a) a phenoxy mono- or poly(oxyalkylene) alcohol, (b) at least one solvent selected from (1) an alkoxy mono- or poly(oxyalkylene) alcohol and (2) an aliphatic or aromatic organic solvent, and (c) at least one nitrogen-containing detergent additive.

The Phenoxy Mono- or Poly(oxyalkylene) Alcohol

The phenoxy mono- or poly(oxyalkylene) alcohol component of the cleaning composition employed in the present invention has the following general formula:

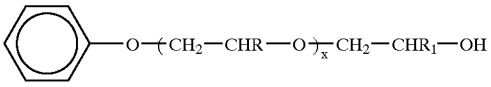

(I)

wherein R, $R_1$ and x are as defined hereinabove.

In Formula I above, R and $R_1$ are preferably hydrogen and x is preferably an integer from 0 to 2. More preferably, R and $R_1$ are hydrogen and x is 0.

Suitable phenoxy mono- or poly(oxyalkylene) alcohols for use in the present invention include, for example, 2-phenoxyethanol, 1-phenoxy-2-propanol, diethylene glycol phenyl ether, propylene ethylene glycol phenyl ether, dipropylene glycol phenyl ether, and the like, including mixtures thereof. A referred phenoxy mono- or poly(oxyalkylene) alcohol is 2-phenoxyethanol. A commercial 2-phenoxyethanol is available from Dow Chemical Company as EPH Dowanol.

The Solvent

The solvent component of the cleaning composition employed in the present invention is at least one solvent select from (1) an alkoxy mono- or poly(oxylene) alcohol and (2) an aliphatic or aromatic organic solvent.

1. The Alkoxy Mono- or Poly(oxyalkylene) Alcohol

The alkoxy mono- or poly(oxyalkylene) alcohol which may be employed in the present invention has the following general formula:

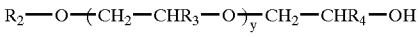

(II)

wherein $R_2$, $R_3$, $R_4$ and y are as defined hereinabove.

In Formula II above, $R_2$ is preferably alkyl of 2 to 6 carbon atoms, $R_3$ and $R_4$ are preferably hydrogen, and y is preferably an integer from 0 to 2. More preferably, $R_2$ is alkyl of 4 carbon atoms (i.e., butyl), $R_3$ and $R_4$ are hydrogen, and y is 0.

Suitable alkoxy mono- or poly(oxyalkylene) alcohols for use in the present invention include, for example, 2-methoxyethanol, 2-ethoxyethanol, 2-n-butoxyethanol, 1-methoxy-2-propanol, 1-ethoxy-2-propanol, 1-n-butoxy-2-propanol, diethylene glycol methyl ether, diethylene glycol butyl ether, propylene ethylene glycol methyl ether, propylene ethylene glycol butyl ether, dipropylene glycol methyl ether, dipropylene glycol butyl ether, and the like, including mixtures thereof. A preferred alkoxy mono- or poly (oxyalkylene) alcohol is 2-n-butoxyethanol. A commercial 2-n-butoxyethanol, or ethylene glycol mono-butyl ether, is available as EB Butyl Cellusolve from Union Carbide, a subsidiary of Dow Chemical Company.

2. The Aliphatic or Aromatic Organic Solvent

An aliphatic or aromatic hydrocarbyl organic solvent may also be employed in the present invention. Suitable aromatic solvents include benzene, toluene, xylene or higher boiling aromatics or aromatic thinners, such as a $C_9$ aromatic solvent. Suitable aliphatic solvents include dearomatized solvents, such as Exxsol D40 and D60, available from ExxonMobil, other aliphatic solvents, such as D15-20 Naphta, D115-145 Naphta and D31-35 Naphta, also available from ExxonMobil, and nonaromatic mineral spirits, and the like. A preferred solvent for use in the present invention is a $C_9$ aromatic solvent.

Preferably, the solvent employed will be a mixture of both an alkoxy mono- or poly(oxyalkylene) alcohol and an aliphatic or aromatic organic solvent. In a particularly preferred embodiment, the solvent will be a mixture of 2-n-butoxyethanol and a $C_9$ aromatic solvent.

The Nitrogen-containing Detergent Additive

The cleaning composition employed in the present invention will also contain at least one nitrogen-containing detergent additive. Suitable detergent additives for use in this invention include, for example, aliphatic hydrocarbyl amines, hydrocarbyl-substituted poly(oxyalkylene) amines, hydrocarbyl-substituted succinimides, Mannich reaction products, nitro and amino aromatic esters of polyalkylphenoxyalkanols, polyalkylphenoxyaminoalkanes, and mixtures thereof.

The aliphatic hydrocarbyl-substituted amines which may be employed in the present invention are typically straight or branched chain hydrocarbyl-substituted amines having at least one basic nitrogen atom and wherein the hydrocarbyl group has a number average molecular weight of about 700 to 3,000. Preferred aliphatic hydrocarbyl-substituted amines include polyisobutenyl and polyisobutyl monoamines and polyamines.

The aliphatic hydrocarbyl amines employed in this invention are prepared by conventional procedures known in the art. Such aliphatic hydrocarbyl amines and their preparations are described in detail in U.S. Pat. Nos. 3,438,757; 3,565,804; 3,574,576; 3,848,056; 3,960,515; 4,832,702; and 6,203,584, the disclosures of which are incorporated herein by reference.

Another class of detergent additives suitable for use in the present invention are the hydrocarbyl-substituted poly (oxyalkylene) amines, also referred to as polyether amines. Typical hydrocarbyl-substituted poly(oxyalkylene) amines include hydrocarbyl poly(oxyalkylene) monoamines and polyamines wherein the hydrocarbyl group contains from 1 to about 30 carbon atoms, the number of oxyalkylene units will range from about 5 to 100, and the amine moiety is derived from ammonia, a primary alkyl or secondary dialkyl monoamine, or a polyamine having a terminal amino nitrogen atom. Preferably, the oxyalkylene moiety will be oxypropylene or oxybutylene or a mixture thereof. Such hydrocarbyl-substituted poly(oxyalkylene) amines are described, for example, in U.S. Pat. No. 6,217,624 to Morris et al., and U.S. Pat. No. 5,112,364 to Rath et al., the disclosures of which are incorporated herein by reference.

A preferred type of hydrocarbyl-substituted poly (oxyalkylene) monoamine is an alkylphenyl poly (oxyalkylene)monoamine wherein the poly(oxyalkylene) moiety contains oxypropylene units or oxybutylene units or mixtures of oxypropylene and oxybutylene units. Preferably, the alkyl group on the alkylphenyl moiety is a straight or branched-chain alkyl of 1 to 24 carbon atoms. An especially preferred alkylphenyl moiety is tetrapropenylphenyl, that is, where the alkyl group is a branched-chain alkyl of 12 carbon atoms derived from propylene tetramer.

An additional type of hydrocarbyl-substituted poly (oxyalkylene)amine finding use in the present invention are hydrocarbyl-substituted poly(oxyalkylene) aminocarbamates disclosed for example, in U.S. Pat. Nos. 4,288,612;

4,236,020; 4,160,648; 4,191,537; 4,270,930; 4,233,168; 4,197,409; 4,243,798 and 4,881,945, the disclosure of each of which are incorporated herein by reference.

These hydrocarbyl poly(oxyalkylene)aminocarbamates contain at least one basic nitrogen atom and have an average molecular weight of about 500 to 10,000, preferably about 500 to 5,000, and more preferably about 1,000 to 3,000. A preferred aminocarbamate is alkylphenyl poly(oxybutylene) aminocarbamate wherein the amine moiety is derived from ethylene diamine or diethylene triamine.

A further class of detergent additives suitable for use in the present invention are the hydrocarbyl-substituted succinimides. Typical hydrocarbyl-substituted succinimides include polyalkyl and polyalkenyl succinimides wherein the polyalkyl or polyalkenyl group has an average molecular weight of about 500 to 5,000, and preferably about 700 to 3,000. The hydrocarbyl-substituted succinimides are typically prepared by reacting a hydrocarbyl-substituted succinic anhydride with an amine or polyamine having at least one reactive hydrogen bonded to an amine nitrogen atom. Preferred hydrocarbyl-substituted succinimides include polyisobutenyl and polyisobutanyl succinimides, and derivatives thereof.

The hydrocarbyl-substituted succinimides finding use in the present invention are described, for example, in U.S. Pat. Nos. 5,393,309; 5,588,973; 5,620,486; 5,916,825; 5,954,843; 5,993,497; and 6,114,542, and British Patent No. 1,486,144, the disclosure of each of which are incorporated herein by reference.

Yet another class of detergent additives which may be employed in the present invention are Mannich reaction products which are typically obtained from the Mannich condensation of a high molecular weight alkyl-substituted hydroxyaromatic compound, an amine containing at least one reactive hydrogen, and an aldehyde. The high molecular weight alkyl-substituted hydroxyaromatic compounds are preferably polyalkylphenols, such as polypropylphenol and polybutylphenol, especially polyisobutylphenol, wherein the polyakyl group has an average molecular weight of about 600 to 3,000. The amine reactant is typically a polyamine, such as alkylene polyamines, especially ethylene or polyethylene polyamines, for example, ethylene diamine, diethylene triamine, triethylene tetramine, and the like. The aldehyde reactant is generally an aliphatic aldehyde, such as formaldehyde, including paraformaldehyde and formalin, and acetaldehyde. A preferred Mannich reaction product is obtained by condensing a polyisobutylphenol with formaldehyde and diethylene triamine, wherein the polyisobutyl group has an average molecular weight of about 1,000.

The Mannich reaction products suitable for use in the present invention are described, for example, in U.S. Pat. Nos. 4,231,759 and 5,697,988, the disclosures of each of which are incorporated herein by reference.

A still further class of detergent additive suitable for use in the present invention are polyalkylphenoxyaminoalkanes. Preferred polyalkylphenoxyaminoalkanes include those having the formula:

(III)

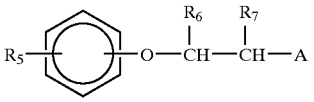

wherein:

$R_5$ is a polyalkyl group having an average molecular weight in the range of about 600 to 5,000;

$R_6$ and $R_7$ are independently hydrogen or lower alkyl having 1 to 6 carbon atoms; and A is amino, N-alkyl amino having about 1 to about 20 carbon atoms in the alkyl group, N,N-dialkyl amino having about 1 to about 20 carbon atoms in each alkyl group, or a polyamine moiety having about 2 to about 12 amine nitrogen atoms and about 2 to about 40 carbon atoms.

The polyalkylphenoxyaminoalkanes of Formula III above and their preparations are described in detail in U.S. Pat. No. 5,669,939, the disclosure of which is incorporated herein by reference.

Mixtures of polyalkylphenoxyaminoalkanes and poly (oxyalkylene) amines are also suitable for use in the present invention. These mixtures are described in detail in U.S. Pat. No. 5,851,242, the disclosure of which is incorporated herein by reference.

A preferred class of detergent additive finding use in the present invention are nitro and amino aromatic esters of polyalkylphenoxyalkanols. Preferred nitro and amino aromatic esters of polyalkylphenoxyalkanols include those having the formula:

(IV)

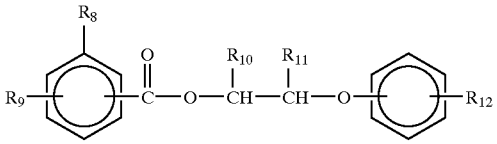

wherein:

R8 is nitro or —$(CH_2)_n$—$NR_{13}R_{14}$, wherein $R_{13}$ and $R_{14}$ are independently hydrogen or lower alkyl having 1 to 6 carbon atoms and n is 0 or 1;

$R_9$ is hydrogen, hydroxy, nitro or —$NR_{15}R_{16}$, wherein $R_{15}$ and $R_{16}$ are independently hydrogen or lower alkyl having 1 to 6 carbon atoms;

$R_{10}$ and $R_{11}$, are independently hydrogen or lower alkyl having 1 to 6 carbon atoms; and $R_{12}$ is a polyalkyl group having an average molecular weight in the range of about 450 to 5,000.

The aromatic esters of polyalkylphenoxyalkanols shown in Formula IV above and their preparations are described in detail in U.S. Pat. No. 5,618,320, the disclosure of which is incorporated herein by reference.

Mixtures of nitro and amino aromatic esters of polyalkylphenoxyalkanols and hydrocarbyl-substituted poly (oxyalkylene) amines are also preferably contemplated for use in the present invention. These mixtures are described in detail in U.S. Pat. No. 5,749,929, the disclosure of which is incorporated herein by reference.

Preferred hydrocarbyl-substituted poly(oxyalkylene) amines which may be employed as detergent additives in the present invention include those having the formula:

(V)

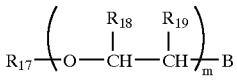

wherein:

$R_{17}$ is a hydrocarbyl group having from about 1 to about 30 carbon atoms;

$R_{18}$ and $R_{19}$ are each independently hydrogen or lower alkyl having about 1 to about 6 carbon atoms and each $R_{18}$ and $R_{19}$ is independently selected in each —O—$CHR_{18}$—$CHR_{19}$— unit;

A is amino, N-alkyl amino having about 1 to about 20 carbon atoms in the alkyl group, N,N-dialkyl amino having about 1 to about 20 carbon atoms in each alkyl group, or a polyamine moiety having about 2 to about 12 amine nitrogen atoms and about 2 to about 40 carbon atoms; and m is an integer from about 5 to about 100.

The hydrocarbyl-substituted poly(oxyalkylene) amines of Formula V above and their preparations are described in detail in U.S. Pat. No. 6,217,624, the disclosure of which is incorporated herein by reference.

The hydrocarbyl-substituted poly(oxyalkylene) amines of Formula V are preferably utilized either by themselves or in combination with other detergent additives, particularly with the polyalkylphenoxyaminoalkanes of Formula III or the nitro and amino aromatic esters of polyalkylphenoxyalkanols shown in Formula IV. More preferably, the detergent additives employed in the present invention will be combinations of the hydrocarbyl-substituted poly(oxyalkylene) amines of Formula V with the nitro and amino aromatic esters of polyalkylphenoxyalkanols shown in Formula IV. A particularly preferred hydrocarbyl-substituted poly (oxyalkylene) amine detergent additive is dodecylphenoxy poly(oxybutylene) amine and a particularly preferred combination of detergent additives is the combination of dodecylphenoxy poly(oxybutylene) amine and 4-polyisobutylphenoxyethyl para-aminobenzoate.

Another type of detergent additive suitable for use in the present invention are the nitrogen-containing carburetor/injector detergents. The carburetor/injector detergent additives are typically relatively low molecular weight compounds having a number average molecular weight of about 100 to about 600 and possessing at least one polar moiety and at least one non-polar moiety. The non-polar moiety is typically a linear or branched-chain alkyl or alkenyl group having about 6 to about 40 carbon atoms. The polar moiety is typically nitrogen-containing. Typical nitrogen-containing polar moieties include amines (for example, as described in U.S. Pat. No. 5,139,534 and PCT International Publication No. WO 90/10051), ether amines (for example, as described in U.S. Pat. No. 3,849,083 and PCT International Publication No. WO 90/10051), amides, polyamides and amide-esters (for example, as described in U.S. Pat. Nos. 2,622,018; 4,729,769; and 5,139,534; and European Pat. Publication No. 149,486), imidazolines (for example, as described in U.S. Pat. No. 4,518,782), amine oxides (for example, as described in U.S. Pat. Nos. 4,810,263 and 4,836,829), hydroxyamines (for example, as described in U.S. Pat. No. 4,409,000), and succinimides (for example, as described in U.S. Pat. No. 4,292,046).

As described above, the cleaning composition employed in the present invention comprises (a) a phenoxy mono- or poly(oxyalkylene) alcohol, (b) at least one solvent selected from (1) an alkoxy mono- or poly(oxyalkylene) alcohol and (2) an aliphatic or aromatic organic solvent, and (c) at least one nitrogen-containing detergent additive. The cleaning composition will generally contain (a) about 10 to 50 weight percent, preferably about 15 to 45 weight percent, of the phenoxy mono- or poly(oxyalkylene) alcohol, (b) about 10 to 30 weight percent, preferably about 15 to 25 weight percent, of the solvent or mixture of solvents, and (c) about 10 to 50 weight percent, preferably about 15 to 45 weight percent, of the detergent additive or mixture of additives. When the solvent component is a mixture of an alkoxy mono- or poly(oxyalkylene) alcohol and an aliphatic or aromatic organic solvent, the cleaning composition will generally contain about 5 to 15 weight percent of the alkoxy mono- or poly(oxyalkylene) alcohol and about 5 to 15 weight percent of the aliphatic or aromatic organic solvent. When the detergent component contains the preferred combination of a poly(oxyalkylene) amine and an aromatic ester of a polyalkylphenoxyalkanol, the cleaning composition will generally contain about 8 to 40 weight percent of the poly(oxyalkylene) amine and about 2 to 10 weight percent of the aromatic ester of a polyalkylphenoxyalkanol.

As mentioned above, in a preferred embodiment, the method of the present invention further comprises the subsequent step of introducing a second cleaning composition into the air-intake manifold of the warmed-up and idling engine and running the engine while the second cleaning composition is introduced. As further described above, the second cleaning composition comprises a homogeneous mixture of (a) a phenoxy mono- or poly(oxyalkylene) alcohol, (b) an alkoxy mono- or poly(oxyalkylene) alcohol, and (c) water.

The phenoxy mono- or poly(oxyalkylene) alcohol component of the second cleaning composition will be a compound or mixture of compounds of Formula I above, and may be the same or different from the phenoxy mono- or poly(oxyalkylene) alcohol component of the initial cleaning composition. Likewise, the alkoxy mono- or poly (oxyalkylene) alcohol component of the second cleaning composition will be a compound or mixture of compounds of Formula II above, and may be the same as or different from the alkoxy mono- or poly(oxyalkylene) alcohol component which may be employed in the initial cleaning composition.

The second cleaning composition will generally contain (a) about 5 to 95 weight percent, preferably about 20 to 85 weight percent, of the phenoxy mono- or poly(oxyalkylene) alcohol, (b) about 5 to 95 weight percent, preferably about 5 to 50 weight percent, of the alkoxy mono- or poly (oxyalkylene) alcohol, and (c) about 5 to 25 weight percent, preferably about 5 to 20 weight percent, of water.

Preferred Application Tools and Procedures

The application tools for delivering the additive components of the cleaning composition comprise a graduated bottle/container (either under atmospheric pressure or pressurized), a metering valve or orifice to control the flow rate of the additive composition, and a tube for uniform distribution of the product inside the intake system and ports. The essential component of the applicator is the tube, which depending on the engine geometry could be fabricated from either rigid or flexible material. Delivery of the additive composition components via this tube could also vary. For example, the tube could be marked to allow traversing between different intake ports or it could have single or multiple holes or orifices machined along its length to eliminate the need to traverse.

In the case of a DISI engine, the tube is inserted inside the PCV (positive crankcase ventilation) rail. The additive composition components could then be either pressure fed or delivered under engine intake vacuum. The tube inserted inside the PCV rail will allow precise and uniform delivery of the additive composition upstream of each intake port for maximum deposit clean up efficiency.

The clean-up procedure is carried out in a fully warmed-up engine and while the engine is running at speeds ranging from manufacturer recommended idle speed to about 3000 RPM. The additive composition flow rate could be controlled to allow a wide range of delivery time. Flow rates ranging from about 10 to 140 ml/min are typically employed, although slower rates below 10 ml/min can be used as well.

In a conventional PFI SI engine, the tube is inserted inside the intake manifold or the intake system via a vacuum line. It is most preferred that the additive composition system gets delivered under pressure using the multiple hole design to achieve optimum distribution of the additive composition. The remainder of the procedures are similar to those described above for the DISI application.

A non-limitive example of a practice arrangement of the invention will be now described with reference to FIG. 1, which is a depiction of one such apparatus for carrying out the method of this invention. Although automotive engines are exemplified and used herein, the methods and apparatus for their use are not limited to such, but can be used in internal combustion engines including trucks, vans, motorboats, stationary engines, etc. One embodiment is directed to engines capable of developing an intake manifold vacuum while running at or slightly above idle speeds. If the engine does not develop manifold vacuum, the apparatus could be pressurized to deliver the product, thus not relying on engine vacuum. FIG. 1 illustrates the application tools for delivering the additive components to discrete locations within an internal combustion engine. The cleaning apparatus (10) includes a reservoir container (20) for holding the cleaning fluids.

These fluids can be a cleaning composition, or a plurality of cleaning compositions applied sequentially. The reservoir can be square, cylindrical or of any suitable shape, manufactured of any chemically resistant material. Transparent or translucent materials are preferred in one aspect since an operator can easily ascertain the quantity and flowrate of fluid dispensed. Additionally, a graduated or otherwise marked reservoir can be utilized to aid in control of the fluid addition.

The reservoir container (20) has a neck (22) and optionally a sealing system such as a threaded cap, cork, plug, valve, or the like which can be removed to provide a re-filling opening upon removal. Such sealing system also can have an integral vent to displace the fluid removed during operation. When the liquid is removed by the vacuum formed through engine suction, the vent can be an air vent and prevent a rigid container from collapsing. Alternatively, the vent could be attached to a pressure source.

In one operation, the fluid is transferred from the container to the desired treatment location using the engine. Engine suction (i.e., vacuum generated by a running engine) is used to dispense the fluid in the reservoir container when the device is in operation and connected to a vacuum port of the engine. The reservoir container (20) has a flexible or fixed siphon tube (24) extending downward terminating (26) towards the bottom of the container. The siphon tube is in fluid contact with fluids held within the container. The siphon tube can be fixed to the wall of the reservoir container, fixed to the sealing system, or freely removable from the neck (22). The siphon tube, upon exiting the reservoir container, is optionally connected to an adjustable valve (30) useful for flow proportioning; and is in communication with a flexible conduit or hose (40) having the proximal portion attached to the siphon tube or the valve when present. The distal portion of the flexible conduit is connected to a treatment manifold (60) which is inserted inside the engine through the intake air system via a vacuum port or otherwise during operation. A seal (50) having a fluid opening therethrough is located between the treatment manifold (60) and the flexible conduit to provide a vacuum seal with the engine while allowing the treatment fluids to flow to the engine.

The treatment manifold allows for uniform distribution of the cleaning composition(s) inside the intake system, runners and ports. The treatment manifold is designed depending upon the engine type, geometry and available intake access including vacuum ports. Accordingly, the treatment manifold may be rigid or flexible, constructed of suitable materials compatible with the cleaning fluids and engine operating conditions. However, the treatment manifold is sized with the constraints that a portion of the treatment manifold enters the engine cavity. Nonlimited locations include the intake opening, vacuum port openings, such as PCV ports, brake booster ports, air conditioning vacuum ports, etc. Delivery of the cleaning compositions via this treatment manifold can also vary. For example, the manifold can have a single opening (62), having optional marking indicative of intake port location and allow for traversing between different intake ports such as: the A and B ports on a multi-valve engine, or a common A/B port leading to a single combustion chamber, or for traversing to intake ports which lead to different combustion chambers. Alternatively, the treatment manifold can contain multiple holes or orifices machined along its length. These multiple orifices can be of differing sizes to improve distribution at one or more locations. Multiple orifices can also serve to reduce or eliminate the need for such traverse. The location of the orifices can correlate to the inlet runners, thereby achieving optimal distribution of the cleaning composition.

The treatment manifold (60) can also consist of multiple tubes attached to flexible conduit (40) where the tubes can be directed dependently or independently to the desired treatment location either through the same or different vacuum points at the engine intake manifold. These multiple tubes can have holes or orifices (62) machined along their length to dispense fluids to a single or to multiple intake ports. The multiple tubes can be constructed of various internal diameters to compensate for the variable vacuum motive force and flow profile at the various orifices. To aid in distribution of the fluid from the open tube orifices, the distal portion of the tube can be optionally fitted with a nozzle to produce a fog or otherwise improve spray distribution.

Figure 2:
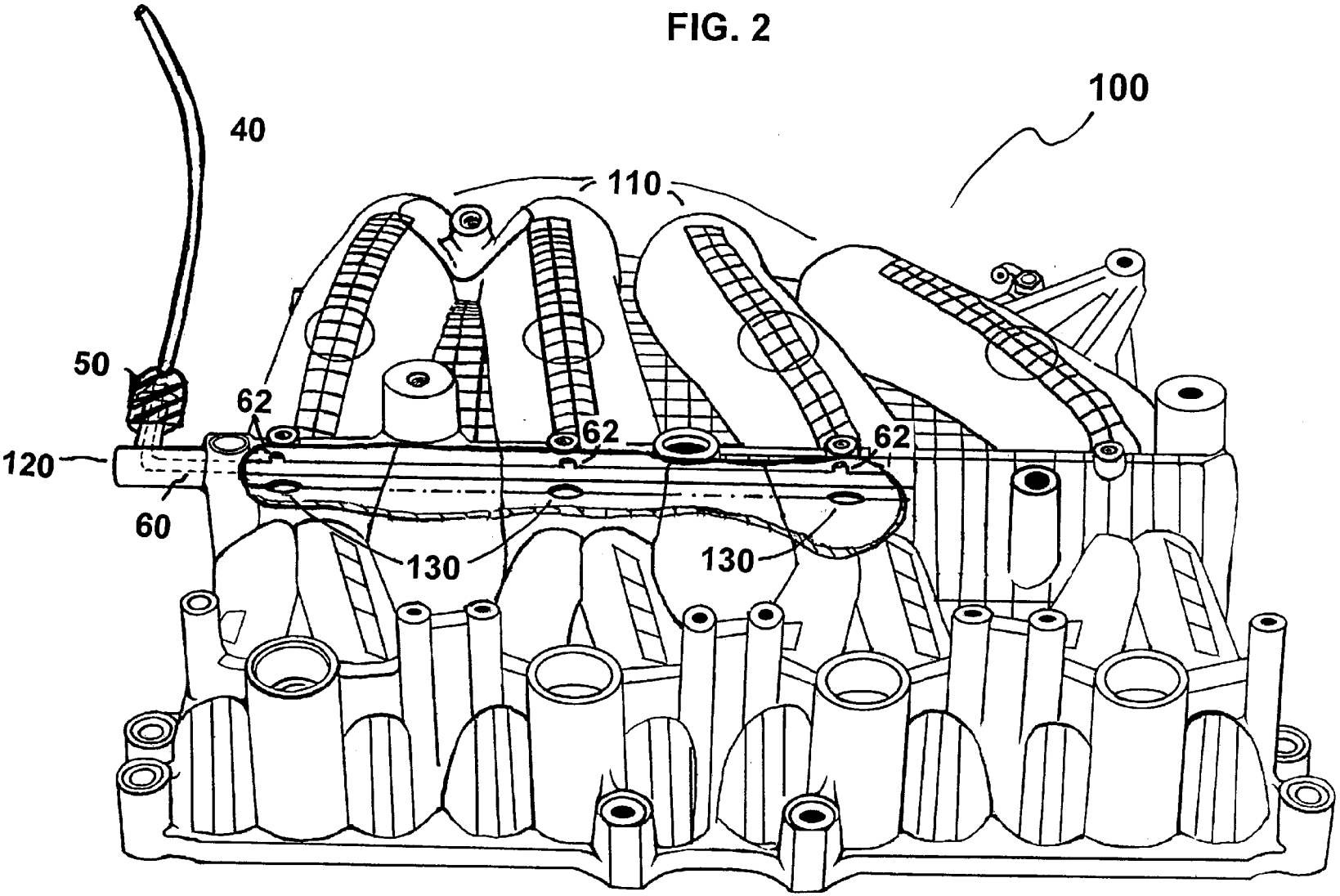
FIG. 2 is a fragmentary view of an engine intake manifold which is being cleaned using an embodiment of the method and apparatus of the present invention.

FIG. 2 is illustrative of a multi-port apparatus for introducing cleaning compositions into the interior cavity of an engine to be treated. Said engine (not shown) has an air intake manifold (100) for supplying combustion air to the combustion chamber (not shown). For multi-port engines the air intake manifold (100) can have a plurality of intake runners (110) leading from the air intake to the combustion chamber. The air intake manifold may also have various access points such as the throttle body, vacuum ports, PCV ports, as well as other connections which are of suitable size to allow for insertion of the transport means, exemplified by the treatment manifold (60), inside the engine cavity. One such port is a PCV rail or PCV port (120) which is in communication with at least one intake runner (110). As illustrated in FIG. 2, this communication is through an open orifice (130) from the PCV rail to the intake runner(s). A treatment manifold (60), having a plurality of orifices (62) is inserted into the PCV rail (120) where optionally, the orifices on the treatment manifold correlate to the orifices on the PCV rail. If necessary, this treatment manifold can traverse the PCV rail. The treatment manifold (60) can optionally be sealed with a plug (50) within the PCV rail to allow for engine vacuum to draw the cleaning composition from the reservoir container.

In operation, the apparatus of this invention (10) can be mounted in any suitable location in proximity to the engine to be treated. A suitable passageway position for the introduction of the treatment components within the air intake manifold is selected for the particular engine and in regard to the specific treatment manifold. For example, for the 1998 Mitsubishi Carisma equipped with a 1.8 L DISI engine, this DISI engine has a PCV rail accessible to the B ports of the intake valves. However, other engines with PCV valves in communication with an internal crankcase chamber of the engine to a PCV fitting on the air intake manifold could serve this purpose. Other locations identified but not preferred in this particular engine were the air inlet and the brake vacuum line. However, these may be preferred in other engines. To set up the apparatus, the engine hose connecting the PCV system is disconnected and the treatment manifold is inserted within this PCV rail with the remainder of the rail opening sealed by the sealing means (50). The cleaning procedure is preferably carried out on a fully warmed engine and while the engine is running at engine speeds ranging from the manufacturer recommended idle speed to approximately 3000 revolutions per minute (RPM). The cleaning composition is then introduced to the discrete engine locations requiring treatment via the treatment manifold. Some applications may require traverse of the manifold. If subsequent cleaning compositions are to be used, they are introduced in like fashion. The apparatus can be pre-calibrated to achieve the desired flowrate or field calibrated during operation. Additionally, such calibration and traverse can be automated. In a DISI engine, the intake portion from the PCV valve to the combustion chamber does not have contact with the fuel and tends to have increased engine deposits on the intake valves. As exemplified herein, the method and apparatus of this invention are directed to providing a solution to this issue.

The above apparatus was defined using engine vacuum generated within the air intake manifold as the fluid motive force. However, in a preferred aspect, the cleaning compositions can be introduced using a modified apparatus having an external pressure source to transfer the cleaning solution into the engine. This external pressure source can be a pressurized aerosol container, a pressurized gas (compressed air, nitrogen, etc.) or, alternatively, a pump can be connected in communication between the siphon tube (24) and the flexible conduit (40). Suitable pumps for delivering and metering fluid flow are known in the art. Suitable pressurized systems are also available in the art and, for example, are described in U.S. Pat. Nos. 4,807,578 and 5,097,806; both incorporated herein by reference in their entirety. Generally, pressurized systems can lead to construction of components having smaller sized dimensions including thinner conduits that need to be placed within the engine (i.e., treatment manifold (60) or other transfer conduits). Additionally, pressurized system can offer opportunities for increased fluid control at the manifold orifice(s) (62). For example, these orifice(s) could be fitted with pressure compensating valves, flow restrictors, and various nozzles to improve the distribution of cleaning compounds. Aerosol pressurized systems are defined by having an aerosol container containing the cleaning composition which can be put into fluid communication with the treatment manifold (60). Pressurized gas systems use a regulated gas in contact with a pressure container containing the cleaning composition, wherein the pressurized gas displaces the fluid to a discharge end which is in fluid communication with the treatment manifold. Both of these systems can optionally contain a pressure regulator, flow valve, filter and shut off valve which can be configured to deliver the cleaning compositions to the desired engine treatment areas, as defined in the above apparatus.

In addition to the methods described above, the cleaning compositions employed in the present invention are also effective in cleaning up engine deposits if mixed directly with gasoline or diesel fuel. As a result, the cleaning compositions could be used to clean both two-stroke and four-stroke spark ignition and compression ignition engines using various types of commercially available applicators.

PREPARATIONS AND EXAMPLES

A further understanding of the invention can be had in the following nonlimiting Examples. Wherein unless expressly stated to the contrary, all temperatures and temperature ranges refer to the Centigrade system and the term "ambient" or "room temperature" refers to about 20° C. to 25° C. The term "percent" or "%" refers to weight percent and the term "mole" or "moles" refers to gram moles. The term "equivalent" refers to a quantity of reagent equal in moles, to the moles of the preceding or succeeding reactant recited in that example in terms of finite moles or finite weight or volume. Where given, proton-magnetic resonance spectrum (p.m.r. or n.m.r.) were determined at 300 mHz, signals are assigned as singlets (s), broad singlets (bs), doublets (d), double doublets (dd), triplets (t), double triplets (dt), quartets (q), and multiplets (m), and cps refers to cycles per second.

Example 1

Preparation of Polyisobutyl Phenol

To a flask equipped with a magnetic stirrer, reflux condenser, thermometer, addition funnel and nitrogen inlet was added 203.2 grams of phenol. The phenol was warmed to 40° C. and the heat source was removed. Then, 73.5 milliliters of boron trifluoride etherate was added dropwise. 1040 grams of Ultravis 10 Polyisobutene (molecular weight 950, 76% methylvinylidene, available from British Petroleum) was dissolved in 1,863 milliliters of hexane. The polyisobutene was added to the reaction at a rate to maintain the temperature between 22° C. to 27° C. The reaction mixture was stirred for 16 hours at room temperature. Then, 400 milliliters of concentrated ammonium hydroxide was added, followed by 2,000 milliliters of hexane. The reaction mixture was washed with water (3×2,000 milliliters), dried over magnesium sulfate, filtered and the solvents removed under vacuum to yield 1,056.5 grams of a crude reaction product. The crude reaction product was determined to contain 80% of the desired product by proton NMR and chromatography on silica gel eluting with hexane, followed by hexane:ethylacetate:ethanol (93:5:2).

Example 2

Preparation of

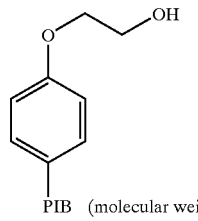

1.1 grams of a 35 weight percent dispersion of potassium hydride in mineral oil and 4- polyisobutyl phenol (99.7 grams, prepared as in Example 1) were added to a flask equipped with a magnetic stirrer, reflux condenser, nitrogen inlet and thermometer. The reaction was heated at 130° C. for one hour and then cooled to 100° C. Ethylene carbonate (8.6 grams) was added and the mixture was heated at 160° C. for 16 hours. The reaction was cooled to room temperature and one milliliter of isopropanol was added. The reaction was diluted with one liter of hexane, washed three times with water and once with brine. The organic layer was dried over anhydrous magnesium sulfate, filtered and the solvents removed in vacuo to yield 98.0 grams of the desired product as a yellow oil.

Example 3

Preparation of

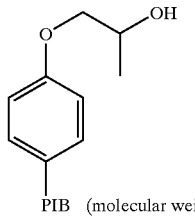

15.1 grams of a 35 weight percent dispersion of potassium hydride in mineral oil and 4-polyisobutyl phenol (1378.5 grams, prepared as in Example 1) were added to a flask equipped with a mechanical stirrer, reflux condenser, nitrogen inlet and thermometer. The reaction was heated at 130° C. for one hour and then cooled to 100° C. Propylene carbonate (115.7 milliliters) was added and the mixture was heated at 160° C. for 16 hours. The reaction was cooled to room temperature and ten milliliters of isopropanol were added. The reaction was diluted with ten liters of hexane, washed three times with water and once with brine. The organic layer was dried over anhydrous magnesium sulfate, filtered and the solvents removed in vacuo to yield 1301.7 grams of the desired product as a yellow oil.

Example 4

Preparation of

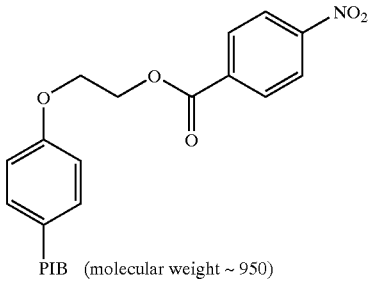

To a flask equipped with a magnetic stirrer, thermometer, Dean-Stark trap, reflux condenser and nitrogen inlet was added 15.0 grams of the alcohol from Example 2, 2.6 grams of 4-nitrobenzoic acid and 0.24 grams of p-toluenesulfonic acid. The mixture was stirred at 130° C. for sixteen hours, cooled to room temperature and diluted with 200 mL of hexane. The organic phase was washed twice with saturated aqueous sodium bicarbonate followed by once with saturated aqueous sodium chloride. The organic layer was then dried over anhydrous magnesium sulfate, filtered and the solvents removed in vacuo to yield 15.0 grams of the desired product as a brown oil. The oil was chromatographed on silica gel, eluting with hexane/ethyl acetate (9:1) to afford 14.0 grams of the desired ester as a yellow oil. $^1$H NMR ($CDCl_3$) d 8.3 (AB quartet, 4H), 7.25 (d, 2H), 6.85 (d, 2H), 4.7 (t, 2H), 4.3 (t, 2H), 0.7–1.6 (m, 137H).

Example 5

Preparation of

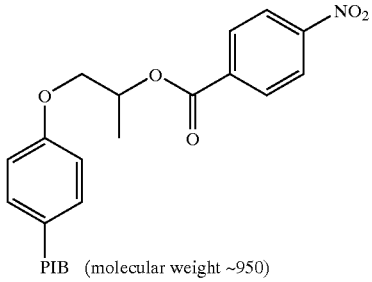

To a flask equipped with a magnetic stirrer, thermometer, Dean-Stark trap, reflux condenser and nitrogen inlet was added 15.0 grams of the alcohol from Example 3, 2.7 grams of 4-nitrobenzoic acid and 0.23 grams of p-toluenesulfonic acid. The mixture was stirred at 130° C. for sixteen hours, cooled to room temperature and diluted with 200 mL of hexane. The organic phase was washed twice with saturated aqueous sodium bicarbonate followed by once with saturated aqueous sodium chloride. The organic layer was then dried over anhydrous magnesium sulfate, filtered and the solvents removed in vacuo to yield 16.0 grams of the desired product as a brown oil. The oil was chromatographed on silica gel, eluting with hexane/ethyl acetate (8:2) to afford 15.2 grams of the desired ester as a brown oil. $^1$H NMR ($CDCl_3$) d 8.2 (AB quartet, 4H), 7.25 (d, 2H), 6.85 (d, 2H), 5.55 (hx, 1H), 4.1 (t, 2H), 0.6–1.8 (m, 140H).

Example 6

Preparation of

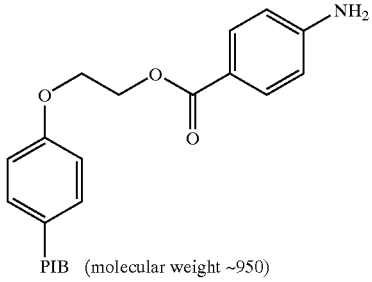

A solution of 9.4 grams of the product from Example 4 in 100 milliliters of ethyl acetate containing 1.0 gram of 10% palladium on charcoal was hydrogenolyzed at 35–40 psi for 16 hours on a Parr low-pressure hydrogenator. Catalyst filtration and removal of the solvent in vacuo yield 7.7 grams of the desired product as a yellow oil. $^1$H NMR ($CDCl_3$) d 7.85 (d, 2H), 7.3 (d, 2H), 6.85 (d, 2H), 6.6 (d, 2H), 4.6 (t, 2H), 4.25 (t, 2H), 4.05 (bs, 2H), 0.7–1.6 (m, 137H)

Example 7

Preparation of

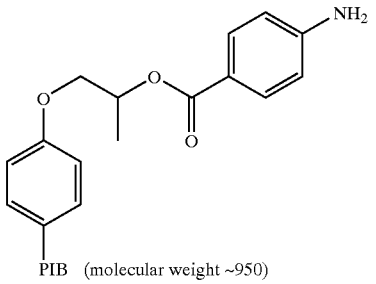

A solution of 15.2 grams of the product from Example 5 in 200 milliliters of ethyl acetate containing 1.0 gram of 10% palladium on charcoal was hydrogenolyzed at 35–40 psi for 16 hours on a Parr low-pressure hydrogenator. Catalyst filtration and removal of the solvent in vacuo yield 15.0 grams of the desired product as a brown oil. $^1$H NMR ($CDCl_3/D_2O$) d 7.85 (d, 2H), 7.25 (d, 2H), 6.85 (d, 2H), 6.6 (d, 2H), 5.4 (hx, 1H), 3.84.2 (m, 4H), 0.6–1.8 (m, 140H).

Example 8

Preparation of Dodecylphenoxy Poly(oxybutylene) poly(oxypropylene) Amine

A dodecylphenoxypoly(oxybutylene)poly(oxypropylene) amine was prepared by the reductive amination with ammonia of the random copolymer poly(oxyalkylene) alcohol, dodecylphenoxy poly(oxybutylene)poly(oxypropylene) alcohol, wherein the alcohol has an average molecular weight of about 1598. The poly(oxyalkylene) alcohol was prepared from dodecylphenol using a 75/25 weight/weight ratio of butylene oxide and propylene oxide, in accordance with the procedures described in U.S. Pat. Nos. 4,191,537; 2,782,240 and 2,841,479, as well as in Kirk-Othmer, "Encyclopedia of Chemical Technology", 4th edition, Volume 19, 1996, page 722. The reductive amination of the poly (oxyalkylene) alcohol was carried out using conventional techniques as described in U.S. Pat. Nos. 5,112,364; 4,609, 377 and 3,440,029.

Example 9

Preparation of Dodecylphenoxy Poly(oxybutylene) Amine

A dodecylphenoxy poly(oxybutylene) amine was prepared by the reductive amination with ammonia of a dodecylphenoxy poly(oxybutylene) alcohol having an average molecular weight of about 1600. The dodecylphenoxy poly (oxybutylene) alcohol was prepared from dodecylphenol and butylene oxide, in accordance with the procedures described in U.S. Pat. Nos. 4,191,537; 2,782,240, and 2,841, 479, as well as in Kirk-Othmer, "Encyclopedia of Chemical Technology", 4th edition, Volume 19, 1996, page 722. The reductive amination of the dodecylphenoxy poly (oxybutylene) alcohol was carried out using conventional techniques as described in U.S. Pat. Nos. 5,112,364; 4,609, 377; and 3,440,029.

Example 10

Application Tools and Procedures

The method for removing engine deposits in an internal combustion engine using cleaning compositions and applying these cleaning compositions to a location requiring cleaning within the interior of the engine is described below. This example was performed using a 1998 Mitsubishi Carisma equipped with a 1.8 Liter DISI engine. However, this is not limiting and such procedures could be modified by those with skill in the art to cover other engine configurations.

Cleaning compositions were prepared as described herein. Two runs of this example (Runs A and B) employed a two-step cleaning composition process. However, a single step could be used. Regarding the preparation of the two part cleaning composition, the first cleaning solution incorporated 2-phenoxyethanol, 2-butoxyethanol, a $C_9$ aromatic solvent and a detergent additive mixture in the weight percents indicated in Table 1.

TABLE 1

First Cleaning Solution

| Component | Weight % |
|---|---|
| Dodecylphenoxy Poly(oxybutylene) Amine | 32.93 |
| 4-Polyisobutylphenoxyethyl para-aminobenzoate | 5.16 |
| C9 aromatic solvent | 9.85 |
| 2-Phenoxyethanol | 42.21 |
| 2-Butoxyethanol | 9.85 |

The dodecylphenoxy poly(oxybutylene) amine was prepared as described in Example 9 and the 4-polyisobutylphenoxyethyl para-aminobenzoate was prepared as described in Example 6. The 2-phenoxyethenol is available from Dow Chemical Company as EPH Dowanol and the 2-butoxyethanol is available as EB Butyl Cellusolve from Union Carbide, a subsidiary of Dow Chemical Company.

The second cleaning composition employed an aqueous solution containing 2-phenoxyethanol and 2-butoxyethanol in the weight percents indicated in Table 2.

TABLE 2

Second Cleaning Solution

| Component | Weight % |
|---|---|
| 2-Phenoxyethanol | 80 |
| 2-Butoxyethanol | 10 |
| Water | 10 |

The first test (Run A outlined below) was conducted using approximately 335 ml of the first cleaning composition followed by approximately 415 ml of the second cleaning composition. A similar second test (Run B) was undertaken using approximately 575 ml of the first cleaning composition followed by approximately 575 ml of the second cleaning composition.

In each test, engine deposits were built up on the test engine by operating the vehicle on a mileage accumulator for approximately 8000 kilometers. Prior to each individual test the engine was disassembled and intake valve deposit weight was measured from the intake valves and the combustion chamber deposit thickness was also recorded. As used herein, the combustion chamber data consists of the cylinder head, piston top, and piston bowl/cavity. The engine was then reassembled with the deposits intact prior to introducing the cleaning compositions.

The apparatus for discretely introducing the cleaning composition was prepared with the cleaning composition held within the reservoir container. This apparatus is illustrated in FIG. 1 and is previously discussed herein. The 1.8L DISI engine was started and allowed to reach normal operating temperatures. It is preferred to carry out the cleaning procedure on a fully warmed-up engine and while the engine is operating. In this case, engine speed was fixed at 1500 revolutions per minute (RPM); however, this procedure could be conducted at manufacturer recommended idle speeds to approximately 3000 RPM. In the case of this DISI engine, a convenient access point for discretely introducing the cleaning composition is the intake manifold and more specifically the positive crankcase ventilation (PCV) rail. This rail is in communication and in closer proximity to the inlet valves; allowing for a more concentrated cleaning composition to be administered upstream of each affected intake port and allowing for increased deposit removal.

A transport means was inserted inside the PCV rail through the PCV port to the desired location to thereby deliver the cleaning composition to each intake port. This aspect used a flexible treatment manifold inserted inside the interior of the engine and having an outlet for transporting the fluid to the location. Coupled with the treatment manifold was a seal for sealing the remainder of the PCV port. The treatment manifold was marked to indicate the desired insertion depth. The treatment manifold allowed for traverse within the PCV rail, so that the treatment manifold outlet could correspond to each intake runner allowing the treatment composition to be evenly distributed amongst the cylinders. A flow control valve in communication with the transport means was set and adjusted to allow for a wide range of delivery of cleaning fluids ranging from about 10 to about 140 milliliters per minute. In the present example, the flow control valve was adjusted to achieve a flow rate of 38 ml/min under intake vacuum. After the flow rate was adjusted, the cleaning composition was distributed sequentially to the inlet ports using a proportional amount of the cleaning composition. In the case of successive cleaning compositions to be introduced, a similar operation as above, was undertaken. Once the process was complete, and no further cleaning compositions were remaining to be added, the engine was run for approximately 3 minutes prior to evaluation of deposit removal.

Upon completion of the clean-up test, the engine was again disassembled and intake deposit weight and deposit thickness was again measured from the intake valves and the combustion chamber. Measurements for these individual runs are presented in Table 3 as average values. Also included within Table 3 is a comparative run (Run C) using the apparatus and method of this example with 670 ml of a commercially available engine deposit cleaner applied as above at a flow rate of 38 ml/min.

TABLE 3

Experimental Data

| Test (before and after) | Intake Valve Deposit Weight (mg) | Piston Top Thickness (mm) | Piston Bowl Thickness (mm) | Cylinder Head Thickness (mm) |
|---|---|---|---|---|
| Run A (dirty) | 195.8 | 196 | 279 | 262 |
| Run A (after cleanup) | 96.3 | 35 | 18 | 107 |
| Run B (dirty) | 292.4 | 191 | 264 | 261 |
| Run B (after cleanup) | 138 | 22 | 2 | 23 |
| Run C[1] (dirty) | 215 | 198 | 283 | 237 |
| Run C[1] (after cleanup) | 135 | 182 | 248 | 218 |

[1]comparative

Table 4 is a table of results displaying engine cleanliness as a calculated percent clean-up based upon the before and after results exemplified by this example. The percent clean-up value is calculated based upon (dirty component—cleaned component)/dirty component multiplied by 100 to yield the percent clean-up of the component. As can be seen, the cleaning compositions employed in this invention provided a significant reduction in both intake system and combustion chamber deposits and performed markedly better when compared to a commercially available engine deposit cleaner. As illustrated in Table 4, although Run C shows some clean-up performance, there is a marked improvement in both the intake valve and combustion chamber clean-up with Runs A and B

TABLE 4

Results

| Test | % Intake Valve Clean-up | % Piston Top Clean-up | % Piston Bowl Clean-up | % Cylinder Head Clean-up |
|---|---|---|---|---|
| Run A | 51 | 82 | 94 | 59 |
| Run B | 53 | 88 | 98 | 91 |
| Run C[1] | 37 | 8 | 12 | 8 |

[1]comparative

These results show a significant reduction in both intake system and combustion chamber deposit levels. In most cases, near 100 percent clean-up of the piston cavity was observed. The total volume of the cleaning compositions could further be adjusted depending upon the desired clean-up level as well as the initial level of deposits.

What is claimed is:

1. A method for removing engine deposits in a gasoline internal combustion engine which comprises introducing a cleaning composition into an air-intake manifold of a warmed-up and idling gasoline internal combustion engine and running the engine while the cleaning composition is being introduced, said cleaning composition comprising:

(a) a phenoxy mono- or poly(oxyalkylene) alcohol having the formula:

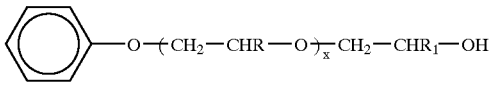

wherein R and $R_1$ are independently hydrogen or methyl and each R is independently selected in each —$CH_2$—CHR—O— unit; and x is an integer from 0 to 4; or mixtures thereof;

(b) at least one solvent selected from:

(1) an alkoxy mono- or poly(oxyalkylene) alcohol having the formula:

$$R_2—O—(CH_2—CHR_3—O)_y—CH_2—CHR_4—OH$$

wherein $R_2$ is alkyl of 1 to about 10 carbon atoms; $R_3$ and $R_4$ are independently hydrogen or methyl and each $R_3$ is independently selected in each —$CH_2$—$CHR_3$—O— unit; and y is an integer from 0 to 4; or mixtures thereof; and (2) an aliphatic or aromatic organic solvent; and (c) at least one nitrogen-containing detergent additive.

2. The method according to claim 1, which further comprises the subsequent step of introducing a second cleaning composition into the air-intake manifold of the warmed-up and idling engine and running the engine while the second cleaning composition is introduced, said second cleaning composition comprising a homogeneous mixture of:

(a) a phenoxy mono- or poly(oxyalkylene) alcohol having the formula:

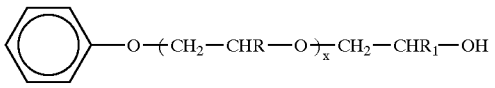

wherein R and $R_1$ are independently hydrogen or methyl and each R is independently selected in each —$CH_2$—CHR—O— unit; and x is an integer from 0 to 4; or mixtures thereof;

(b) an alkoxy mono- or poly(oxyalkylene) alcohol having the formula:

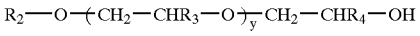

wherein $R_2$ is alkyl of 1 to about 10 carbon atoms; $R_3$ and $R_4$ are independently hydrogen or methyl and each $R_3$ is independently selected in each —$CH_2$—$CHR_3$—O— unit; and y is an integer from 0 to 4; or mixture thereof; and (c) water.

3. The method according to claim 1, wherein R and $R_1$ in the phenoxy mono- or poly(oxyalkylene) alcohol are hydrogen and x is an integer from 0 to 2.

4. The method according to claim 1, wherein the phenoxy mono- or poly(oxyalkylene) alcohol is 2-phenoxyethanol.

5. The method according to claim 1, wherein $R_2$ in the alkoxy mono- or poly(oxyalkylene) alcohol is alkyl of 2 to 6 carbon atoms, $R_3$ and $R_4$ are hydrogen, and y is an integer from 0 to 2.

6. The method according to claim 1, wherein the alkoxy mono- or poly(oxyalkylene) alcohol is 2-n-butoxyethanol.

7. The method according to claim 1, wherein the solvent is a mixture of an alkoxy mono- or poly(oxyalkylene) alcohol and an aliphatic or aromatic organic solvent.

8. The method according to claim 7, wherein the solvent is a mixture of 2-n-butoxyethanol and a $C_9$ aromatic solvent.

9. The method according to claim 1, wherein the detergent additive is a hydrocarbyl-substituted poly(oxyalkylene) amine.

10. The method according to claim 1, wherein the detergent additive is a nitro or amino aromatic ester of a polyakylphenoxyalkanol.

11. The method according to claim 1, wherein the detergent additive is a mixture of a hydrocarbyl-substituted poly(oxyalkylene) amine and a nitro or amino aromatic ester of a polyakylphenoxyalkanol.

12. The method according to claim 11, wherein the detergent additive is a mixture of dodecylphenoxypoly (oxbutylene) amine and 4-polyisobutylphenoxyethyl para-aminobenzoate.

13. The method according to claim 1, wherein the cleaning composition comprises (a) about 10 to 50 weight percent of the phenoxy mono- or poly(oxyalkylene) alcohol, (b) about 10 to 30 weight percent of the solvent or mixture of solvents, and (c) about 10 to 50 weight percent of the detergent additive or mixture of detergent additives.

14. The method according to claim 1, wherein the gasoline engine is a port fuel injected spark ignition engine.

15. The method according to claim 1, wherein the gasoline engine is a direct injection spark ignition engine.

16. The method according to claim 1, wherein the cleaning composition is introduced into the air intake manifold at a flow rate of about 10 to 140 milliliters per minute.

17. The method according to claim 1, wherein the cleaning composition is introduced into the air-intake manifold of the warmed-up and idling gasoline internal combustion engine through a transport means inserted into and located within the interior of the engine to thereby deliver the cleaning composition to each combustion chamber of the engine, wherein the transport means is separate from the fuel delivery system of the engine.

18. The method according to claim 17, wherein the transport means is a rigid or flexible tube having a single opening or multiple orifices.

19. The method according to claim 17, wherein the gasoline engine is a direct injection spark ignition engine and the transport means is inserted into the positive crankcase ventilation rail of the engine.

20. The method according to claim 2, wherein R and $R_1$ in the phenoxy mono- or poly(oxyalkylene) alcohol are hydrogen and x is an integer from 0 to 2.

21. The method according to claim 2, wherein the phenoxy mono- or poly(oxyalkylene) alcohol is 2-phenoxyethanol.

22. The method according to claim 2, wherein $R_2$ in the alkoxy mono- or poly(oxyalkylene) alcohol is alkyl of 2 to 6 carbon atoms, $R_3$ and $R_4$ are hydrogen, and y is an integer from 0 to 2.

23. The method according to claim 2, wherein the alkoxy mono- or poly(oxyalkylene) alcohol is 2-n-butoxyethanol.

24. The method according to claim 2, wherein the cleaning composition comprises (a) about 5 to 95 weight percent of the phenoxy mono- or poly(oxyalkylene) alcohol, (b) about 5 to 95 weight percent of the alkoxy mono- or poly(oxyalkylene) alcohol, and (c) about 5 to 25 weight of water.

25. The method according to claim 2, wherein the gasoline engine is a port fuel injected spark ignition engine.

26. The method according to claim 2, wherein the gasoline engine is a direct injection spark ignition engine.

27. The method according to claim 2 wherein the cleaning composition is introduced into the air intake manifold at a flow rate of about 10 to 140 milliliters per minute.

28. The method according to claim 2, wherein the cleaning composition is introduced into the air-intake manifold of the warmed-up and idling gasoline internal combustion engine through a transport means inserted into and located within the interior of the engine to thereby deliver the cleaning composition to each combustion chamber of the engine, wherein the transport means is separate from the fuel delivery system of the engine.

29. The method according to claim 28, wherein the transport means is a rigid or flexible tube having a single opening or multiple orifices.

30. The method according to claim 28, wherein the gasoline engine is a direct injection spark ignition engine and the transport means is inserted into the positive crankcase ventilation rail of the engine.

* * * * *